US008393977B1

(12) United States Patent
Hettinger et al.

(10) Patent No.: US 8,393,977 B1
(45) Date of Patent: Mar. 12, 2013

(54) GOLF CLUB

(75) Inventors: Ronald K. Hettinger, Oceanside, CA (US); Matthew T. Cackett, San Diego, CA (US); Patrick C. Koegler, Washougal, WA (US)

(73) Assignee: Callaway Golf Company, Carlsbad, CA (US)

( * ) Notice: Subject to any disclaimer, the term of this patent is extended or adjusted under 35 U.S.C. 154(b) by 364 days.

(21) Appl. No.: 12/879,825

(22) Filed: Sep. 10, 2010

(51) Int. Cl.
*A63B 53/04* (2006.01)

(52) U.S. Cl. ..... 473/345

(58) Field of Classification Search ..... 473/324–350
See application file for complete search history.

(56) References Cited

U.S. PATENT DOCUMENTS

| | | | | |
|---|---|---|---|---|
| 5,346,217 | A * | 9/1994 | Tsuchiya et al. | 473/345 |
| 6,254,494 | B1 * | 7/2001 | Hasebe et al. | 473/349 |
| 6,340,337 | B2 * | 1/2002 | Hasebe et al. | 473/349 |
| 6,425,832 | B2 * | 7/2002 | Cackett et al. | 473/345 |
| 6,494,790 | B1 * | 12/2002 | Toyota et al. | 473/345 |
| 6,572,489 | B2 * | 6/2003 | Miyamoto et al. | 473/291 |
| 6,572,491 | B2 * | 6/2003 | Hasebe et al. | 473/349 |
| 6,623,374 | B1 * | 9/2003 | Helmstetter et al. | 473/291 |
| 6,719,643 | B1 * | 4/2004 | Helmstetter et al. | 473/305 |
| 6,743,118 | B1 * | 6/2004 | Soracco | 473/342 |
| 7,025,692 | B2 * | 4/2006 | Erickson et al. | 473/335 |
| 7,097,573 | B2 * | 8/2006 | Erickson et al. | 473/345 |
| 7,147,570 | B2 * | 12/2006 | Toulon et al. | 473/290 |
| 7,147,575 | B2 * | 12/2006 | Galloway et al. | 473/329 |
| 7,169,060 | B2 * | 1/2007 | Stevens et al. | 473/329 |
| 7,258,630 | B2 * | 8/2007 | Erickson et al. | 473/345 |
| 7,445,564 | B2 * | 11/2008 | Kusumoto | 473/346 |
| 7,500,926 | B2 * | 3/2009 | Rae et al. | 473/345 |
| 7,674,189 | B2 * | 3/2010 | Beach et al. | 473/345 |
| 7,674,190 | B2 * | 3/2010 | Galloway et al. | 473/345 |
| 7,731,603 | B2 * | 6/2010 | Beach et al. | 473/335 |
| 7,753,806 | B2 * | 7/2010 | Beach et al. | 473/334 |
| 7,789,774 | B2 * | 9/2010 | Rae et al. | 473/345 |
| 7,803,065 | B2 * | 9/2010 | Breier et al. | 473/334 |
| 8,088,021 | B2 * | 1/2012 | Albertsen et al. | 473/327 |
| 8,167,737 | B2 * | 5/2012 | Oyama | 473/330 |

* cited by examiner

*Primary Examiner* — Alvin Hunter
(74) *Attorney, Agent, or Firm* — Michael A. Catania; Rebecca Hanovice; Sonia Lari

(57) ABSTRACT

A fairway wood type golf club head is disclosed herein. The fairway wood golf club head preferably has a large size relative to traditional fairway wood type golf club heads. Further, the fairway wood type golf club head preferably has a height no greater than 1.6 inches, a length no greater than 4.1 inches and a volume greater than 270 cubic centimeters.

8 Claims, 4 Drawing Sheets

GOLF CLUB

CROSS REFERENCES TO RELATED APPLICATIONS

The present application claims priority to U.S. Patent Provisional Application No. 61/139,410, filed on Dec. 19, 2009.

STATEMENT REGARDING FEDERALLY SPONSORED RESEARCH OR DEVELOPMENT

Not Applicable

BACKGROUND OF THE INVENTION

1. Field of the Invention

The present invention relates to a golf club. More specifically, the present invention relates to a golf club having a.

2. Description of the Related Art

The prior art discloses other fairway woods.

Traditional fairway wood designs have relatively small head sizes. Callaway Golf Company's Big Bertha and Fusion fairway woods are typical in footprint and volume of traditional fairway wood designs. Adams Golf some years ago had success with their TIGHTLIES fairway woods, but the footprint at address was fairly traditional. Recently Golfsmith (through their brand SNAKE EYES) introduced a larger footprint fairway wood, but of still limited size.

There is a need for larger-headed fairway woods since driver head sizes have increased so dramatically in the last few years. For the average 12-handicap golfer, who has just 'duffed' his drive 50 yards down the fairway with his 460 cc driver, to then pull out a traditionally-sized 3-wood can be intimidating. The contrast in size does not inspire confidence.

BRIEF SUMMARY OF THE INVENTION

The present invention is a large fairway wood type golf club head design in both profile at address and in volume. The face profile of the fairway wood type golf club head is also very low, especially as a proportion to profile and volume. All these features are designed to improve on all past designs in several ways. 1) Visually inspire confidence with a large head, similar in size to a 460 cc driver, which is also long in the heel-toe dimension; 2) Improve performance and forgiveness with the largest (that we know of) moments of inertia; and 3) Improve performance through better center of gravity ("CG") placement to help launch the ball high with low spin than traditional fairway woods.

The objectives of this fairway wood type golf club head design are to provide golfers with a better fairway wood design that leverages driver-design knowledge to optimize performance through better CG-moment of inertia "MOI") materials, and a confidence-inspiring shape. Through a larger head profile, MOI values previously unheard of in fairway wood golf club head design can be achieved with the present invention. This larger footprint also gives a much larger heel-toe face dimension, which will inspire confidence in golfers.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
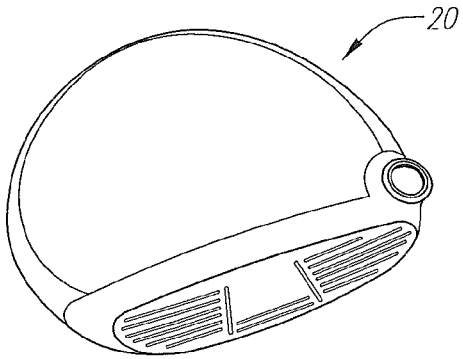
FIG. 1 is a top perspective view of a preferred embodiment of a fairway wood type golf club head of the invention.
Figure 2:
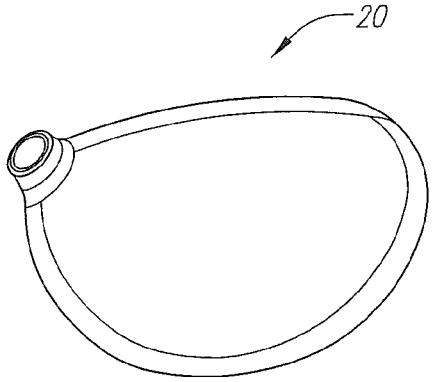
FIG. 2 is a top plan view of a preferred embodiment of a fairway wood type golf club head of the invention.
Figure 3:
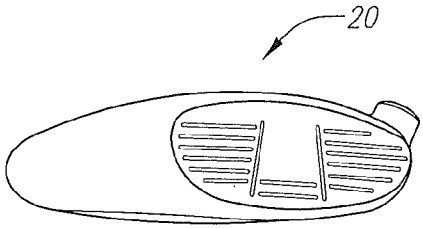
FIG. 3 is a vertical front view of a preferred embodiment of a fairway wood type golf club head of the invention.
Figure 4:
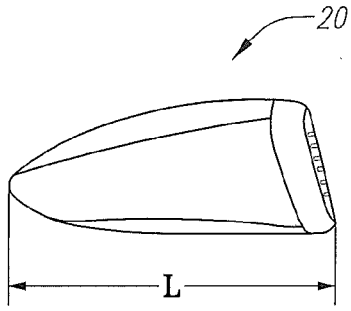
FIG. 4 is a toe side view of a preferred embodiment of a fairway wood type golf club head of the invention.
Figure 5:
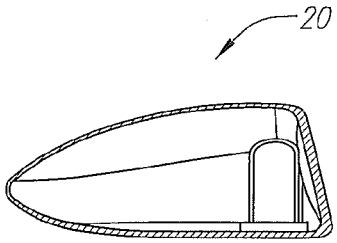
FIG. 5 is a cross-sectional view of a preferred embodiment of a fairway wood type golf club head of the invention along line 5-5 of FIG. 9.
Figure 6:
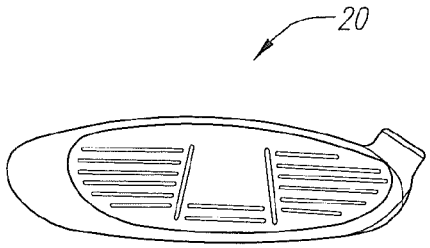
FIG. 6 is a front plan view of a preferred embodiment of a fairway wood type golf club head of the invention.
Figure 7:
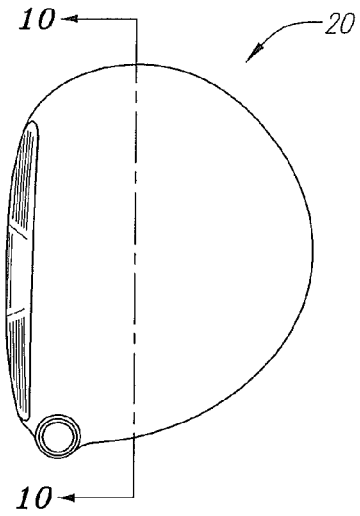
FIG. 7 is a top plan view of a preferred embodiment of a fairway wood type golf club head of the invention.
Figure 8:
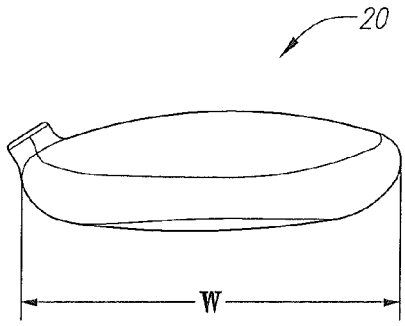
FIG. 8 is a rear plan view of a preferred embodiment of a fairway wood type golf club head of the invention.
Figure 10:
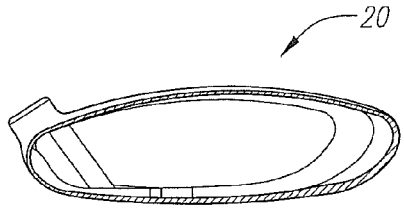
FIG. 10 is a cross-sectional view of a preferred embodiment of a fairway wood type golf club head of the invention along line 10-10 of FIG. 7.
Figure 9:
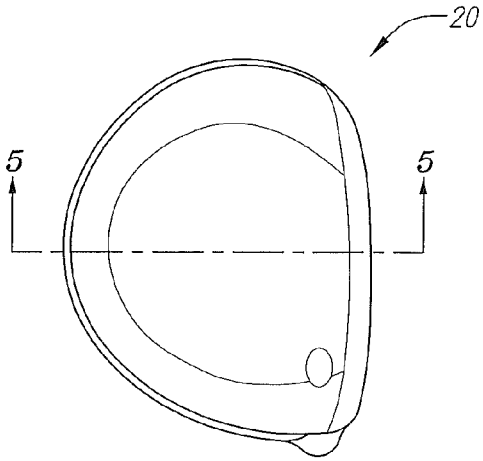
FIG. 9 is a bottom plan view of a preferred embodiment of a fairway wood type golf club head of the invention.
Figure 11:
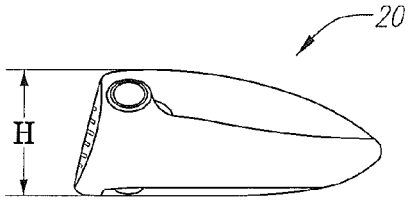
FIG. 11 is a heel side view of a preferred embodiment of a fairway wood type golf club head of the invention.
Figure 12:
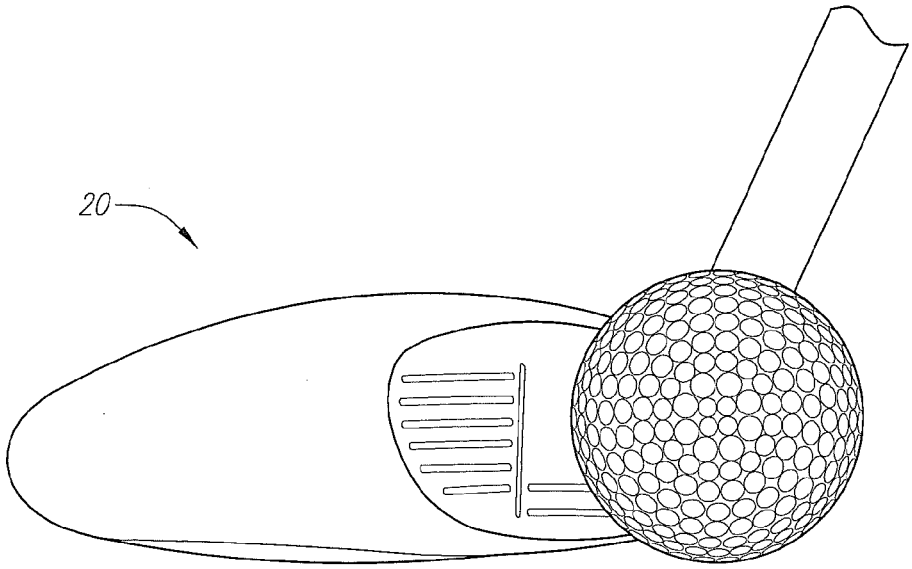
FIG. 12 is an isolated view of a preferred embodiment of a fairway wood type golf club head of the invention about to impact a golf ball.
Figure 13:
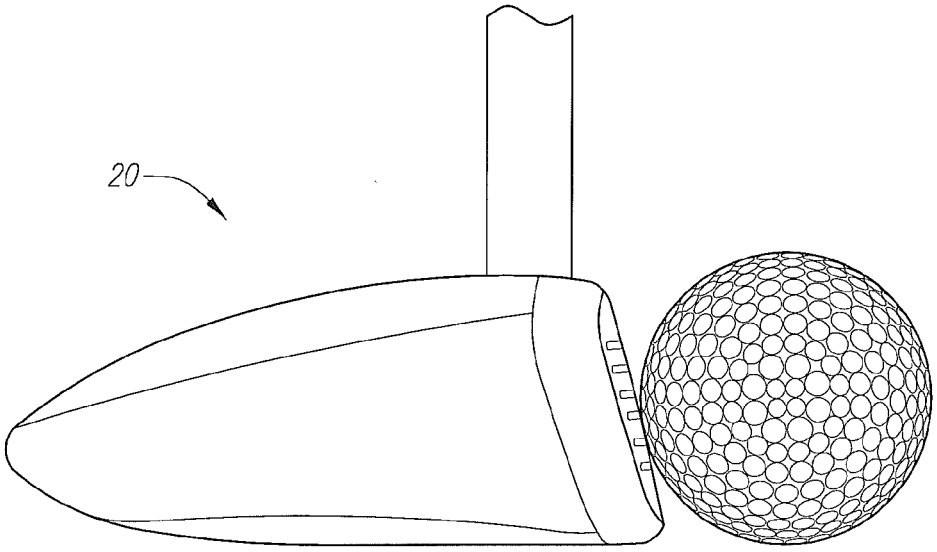
FIG. 13 is an isolated view of a preferred embodiment of a fairway wood type golf club head of the invention impacting a golf ball.
Figure 14:
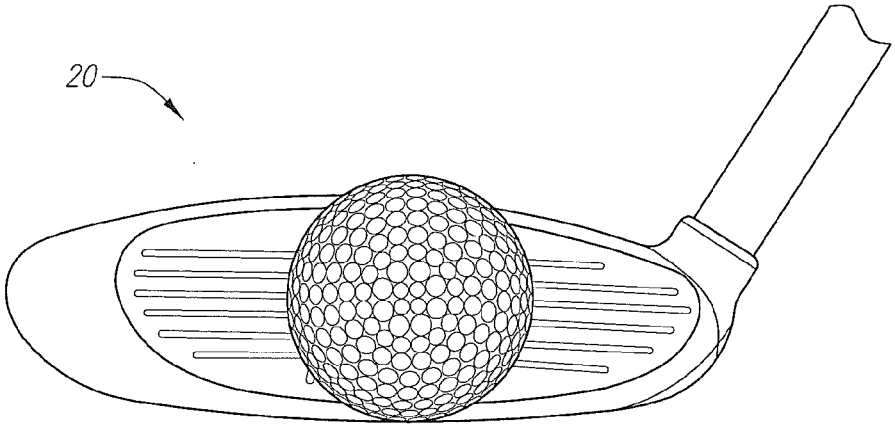
FIG. 14 is an isolated front view of a preferred embodiment of a fairway wood type golf club head of the invention impacting a golf ball.
Figure 15:
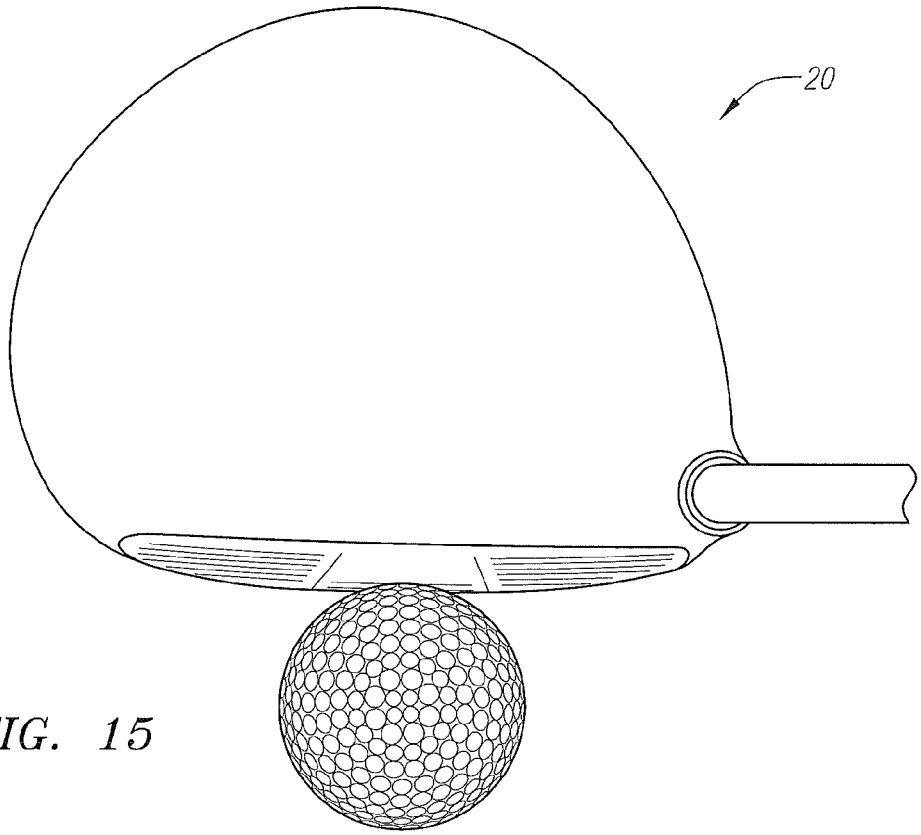
FIG. 15 is an isolated top plan view of a preferred embodiment of a fairway wood type golf club head of the invention impacting a golf ball.

As shown in the FIG. 4, the fairway wood type golf club head has a length, "L", preferably ranging from 3.0 inches to 5.0 inches, more preferably ranging from 3.5 inches to 4.5 inches, and most preferably approximately 4.1 inches. As shown in FIG. 8, the fairway wood type golf club head has a width, "W", preferably ranging from 3.0 inches to 5.5 inches, more preferably ranging from 4.0 inches to 5.0 inches, and most preferably approximately 4.7 inches. As shown in FIG. 11, the fairway wood type golf club head has a height, "H", preferably ranging from 1.0 inch to 2.0 inches, more preferably ranging from 1.5 inches to 1.75 inches, and most preferably approximately 1.6 inches The present invention is an improved fairway wood golf club head design that is intended to be used in the normal and traditional way. The golf club head design provides superior performance compared to traditional fairway wood designs, but is used by the golfer in the same way as the traditional design.

Table One illustrates a head frame CG-MOI measurement for a preferred embodiment of the golf club head of the present invention. The example fairway wood type golf club head has a volume of 272 cubic centimeters.

TABLE One

| | |
|---|---|
| Mass | 204.167436 |
| CgX | 0.755351 |
| CgY | 1.186274 |
| CgZ | 0.579007 |
| Ixx | 2711.977390 |

TABLE One-continued

| | |
|---|---|
| Iyy | 1835.924750 |
| Izz | 4010.910382 |
| Iyz | 42.944729 |
| Ixz | −90.393044 |
| Ixy | 221.084060 |

Table Two illustrates a hosel frame measurement for a preferred embodiment of the golf club head of the present invention.

TABLE Two

| | |
|---|---|
| CgX | −1.720154 |
| CgY | 1.395782 |
| CgZ | −0.755351 |
| Ixx | 3438.741505 |
| Iyy | 2408.093626 |
| Izz | 2711.977390 |
| Iyz | −139.588901 |
| Ixz | 193.814352 |
| Ixy | −958.606338 |

Table Three illustrates a face frame CG measurement for a preferred embodiment of the golf club head of the present invention.

TABLE Three

| | |
|---|---|
| CgZ | 0.122173 |
| CgY | 0.007204 |
| CgX | 1.321935 |

As shown in the figures, a fairway-type golf club head has several components including a body having a striking plate section and a sole section, and a crown. The body is preferably cast from a stainless steel material or titanium alloy. In one embodiment, the crown is composed of a composite material.

The golf club head preferably has a volume from 150 cubic centimeters to 420 cubic centimeters, more preferably from 200 cubic centimeters to 370 cubic centimeters. The volume of the golf club head varies between fairway woods (preferably ranging from 3-woods to eleven woods).

The golf club head preferably has a mass of 135 grams to 300 grams, and preferably from 140 grams to 185 grams.

The weight members preferably have a mass ranging from 5 grams to 50 grams, more preferably from 10 grams to 30 grams, and most preferably from 15 grams to 25 grams. The weight members are preferably composed of a material that has a density ranging from 5 grams per cubic centimeters to 20 grams per cubic centimeters, more preferably from 7 grams per cubic centimeters to 12 grams per cubic centimeters.

The weight members are preferably composed of a polymer material integrated with a metal material. The metal material is preferably selected from copper, tungsten, steel, aluminum, tin, silver, gold, platinum, or the like. A preferred metal is tungsten due to its high density. The polymer material is a thermoplastic or thermosetting polymer material. A preferred polymer material is polyurethane, epoxy, nylon, polyester, or similar materials. A most preferred polymer material is a thermoplastic polyurethane. A preferred weight member is an injection molded thermoplastic polyurethane integrated with tungsten to have a density of 8.0 grams per cubic centimeters. In an alternative embodiment, the weight member is composed of from 50 to 95 volume percent polyurethane and from 50 to 5 volume percent tungsten. Also, in an alternative embodiment, the weight member is composed of from 10 to 25 weight percent polyurethane and from 90 to 75 weight percent tungsten. The placement of the weight member allows for the moment of inertia of the golf club head to be optimized.

The striking plate has varying thickness. In a preferred embodiment, the striking plate has a varying thickness such as described in U.S. Pat. No. 7,448,960, for a Golf Club Head With Variable Face Thickness, which pertinent parts are hereby incorporated by reference. Other alternative embodiments of the thickness of the striking plate 72 are disclosed in U.S. Pat. No. 6,398,666, for a Golf Club Striking Plate With Variable Thickness, U.S. Pat. No. 6,471,603, for a Contoured Golf Club Face and U.S. Pat. No. 6,368,234, for a Golf Club Striking Plate Having Elliptical Regions Of Thickness, all of which are owned by Callaway Golf Company and which pertinent parts are hereby incorporated by reference. Alternatively, the striking plate has a uniform thickness.

The body is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 43 is composed of 17-4 steel alloy. Additional methods for manufacturing the body include forming the body from a flat sheet of metal, super-plastic forming the body from a flat sheet of metal, machining the body from a solid block of metal, electrochemical milling the body from a forged preform, casting the body using centrifugal casting, casting the body using levitation casting, and like manufacturing methods.

The center of gravity and the moment of inertia of a golf club head are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction. Those skilled in the pertinent art will recognize other methods to determine the center of gravity and moments of inertia of a golf club head.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A fairway wood type golf club head comprising:

a body composed of a first material, the body having a striking plate section a sole section and a crown section;

wherein the body has a height no greater than 1.6 inches, a length no greater than 4.1 inches and a volume greater than 270 cubic centimeters;

wherein the golf club head has a width of at least 4.7 inches.

2. The fairway wood type golf club head according to claim 1 wherein the body is composed of a stainless steel material.

3. The fairway wood type golf club head according to claim 1 wherein the body is composed of a titanium alloy material.

4. The fairway wood type golf club head according to claim 1 wherein the golf club head has a loft angle of the striking plate of at least thirteen degrees.

5. A fairway wood type golf club head comprising:

a body composed of a first material, the body having a striking plate section a sole section and a crown section;

wherein the body has a height no greater than 1.6 inches, a length no greater than 4.1 inches and a volume greater than 270 cubic centimeters;

wherein the golf club head has a moment of inertia Ixx through a center of gravity of the fairway wood type golf club head greater than 2700 grams-centimeters squared.

6. A fairway wood type golf club head comprising:

a body composed of a first material, the body having a striking plate section a sole section and a crown section;

wherein the body has a height no greater than 1.6 inches, a length no greater than 4.1 inches and a volume greater than 270 cubic centimeters;

wherein the golf club head has a moment of inertia Iyy through a center of gravity of the fairway wood type golf club head greater than 1800 grams-centimeters squared.

7. A fairway wood type golf club head comprising:

a body composed of a first material, the body having a striking plate section a sole section and a crown section;

wherein the body has a height no greater than 1.6 inches, a length no greater than 4.1 inches and a volume greater than 270 cubic centimeters;

wherein the golf club head has a moment of inertia Izz through a center of gravity of the fairway wood type golf club head greater than 4000 grams-centimeters squared.

8. The fairway wood type golf club head according to claim 7 wherein the golf club head has a width of at least 4.7 inches.

* * * * *